United States Patent [19]

Nelson

[11] 3,939,457

[45] Feb. 17, 1976

[54] AIR FILTER RESTRICTION INDICATING DEVICE

[76] Inventor: Richard Donald Nelson, 711 River St., Decorah, Iowa 52101

[22] Filed: Nov. 7, 1974

[21] Appl. No.: 521,697

[52] U.S. Cl. ..... 340/239 F; 55/274; 73/38; 116/DIG. 25; 210/90

[51] Int. Cl.[2] ..... G08B 21/00

[58] Field of Search ..... 73/406, 408, 146.8, 146.2, 73/38; 55/274; 210/90; 340/239 F; 200/83 N; 116/DIG. 25, 117 C

[56] References Cited

UNITED STATES PATENTS

| | | | |
|---|---|---|---|
| 2,296,667 | 9/1942 | Hemphill | 200/83 N |
| 3,066,527 | 12/1962 | Stein | 73/118 |
| 3,388,682 | 6/1968 | Whiting | 210/90 |
| 3,443,365 | 5/1969 | Lee et al. | 55/274 |
| 3,492,968 | 2/1970 | Workman, Jr. | 73/406 |
| 3,704,458 | 11/1972 | Buchanan et al. | 340/239 F |

*Primary Examiner*—Bernard Nozick
*Attorney, Agent, or Firm*—Leo Gregory

[57] ABSTRACT

An air filter restriction detection device communicating with the air stream passing from an air filter to the air intake of an internal combustion engine sensing a decrease in the supply of air being drawn through said air filter by said engine and the same being indicated by the linear movement of an indicating member in said device, said device indicating also when said air filter requires cleaning or replacement for lack of a sufficient supply of air being drawn therethrough.

2 Claims, 12 Drawing Figures

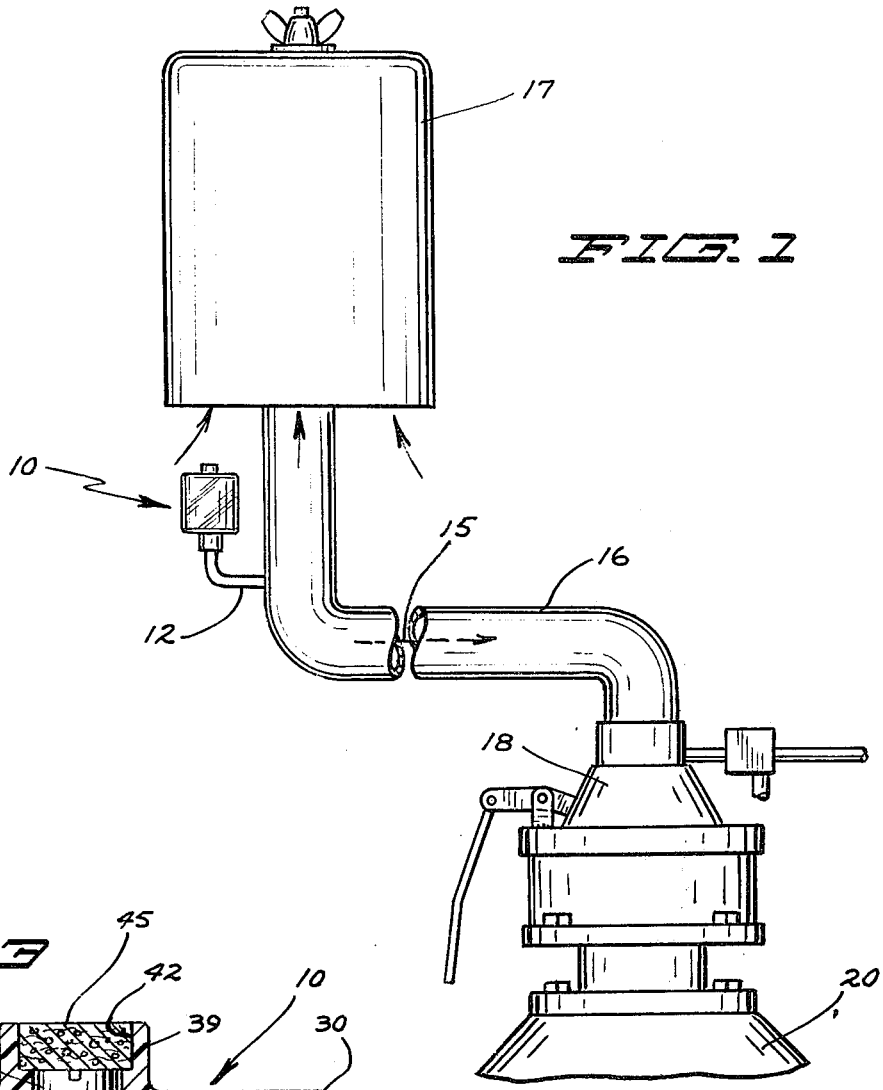
FIG. 1
FIG. 3
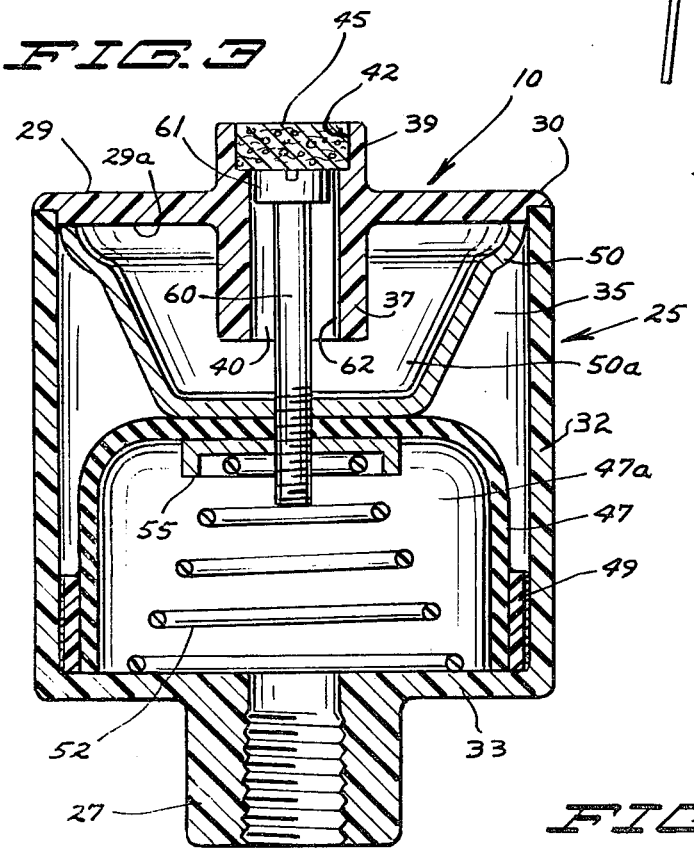
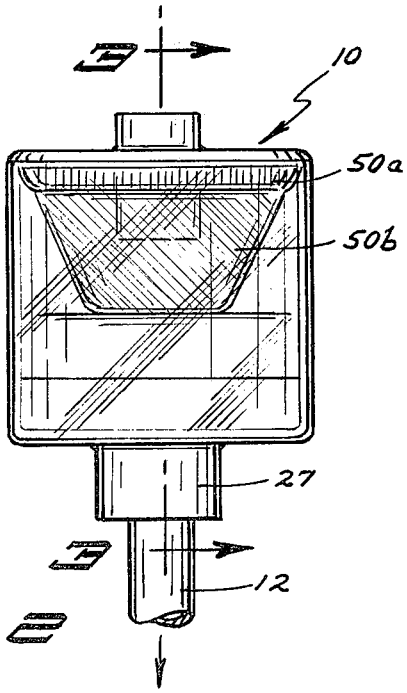
FIG. 2

FIG. 4
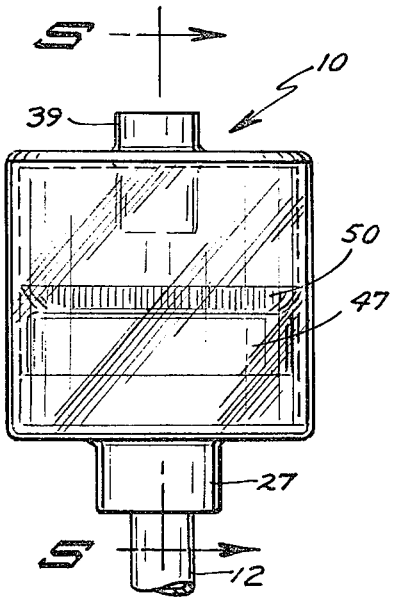
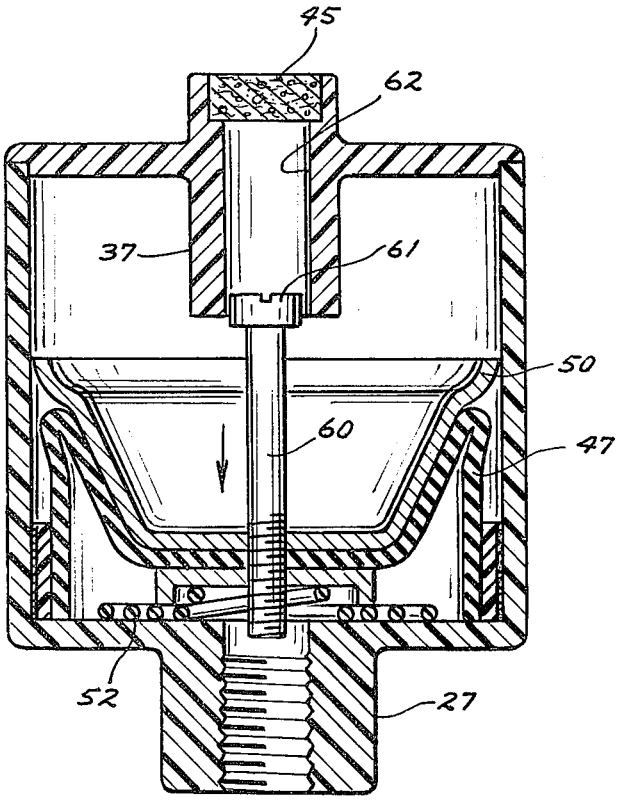
FIG. 5
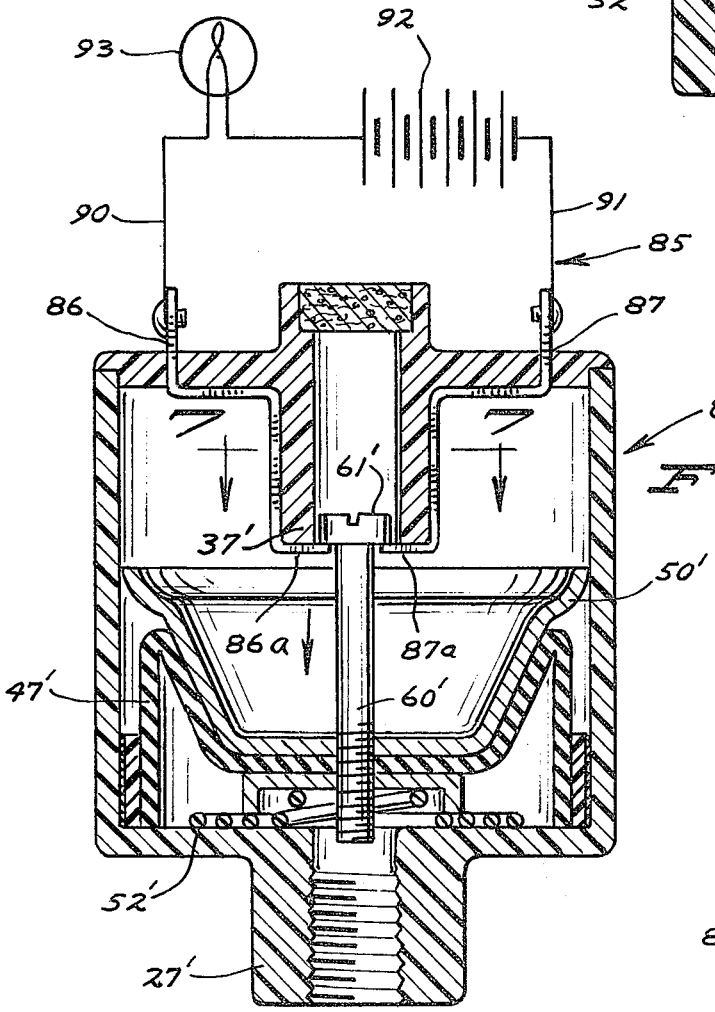
FIG. 6
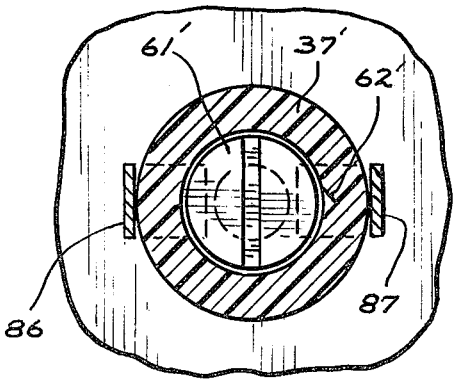
FIG. 7

AIR FILTER RESTRICTION INDICATING DEVICE

BACKGROUND AND SUMMARY OF THE INVENTION

The device herein is used in connection with an air filter for an internal combustion engine. Said device indicates when said air filter has become so loaded with contaminants that the supply of air required by the engine for operating efficiency is not being drawn through the filter by the engine and that the filter requires cleaning or replacement.

Said device gives a continuous reading to indicate the build up of contaminants within the air filter to inform the operator of the condition of the filter. However, said device does away with guess work as to the time when cleaning or replacement of the air filter is necessary and thus provides for maximum use of the air filter. As to the same for cleaning or replacement of the air filter, the device herein gives a positive indication.

It is an object of the invention herein therefore to provide a device in connection with an air filter for an internal combustion engine to give a positive indication as to the need for cleaning or replacing the air filter.

It is another object of this invention to provide a device in connection with an air filter for an internal combustion engine to give a continuous visual reading as to the build up of contaminants within the air filter and to indicate the remaining use period of said air filter prior to cleaning or replacement.

It is another object of this invention to provide a device in communication with the air stream passing from an air filter to the air intake of an internal combustion engine to indicate the degree of contamination of said air filter with said device being readily adjusted to respond to the varying air requirements of different internal combustion engines.

It is also an object of this invention to provide a device as above indicated which is of simple construction and which is readily installed in operating position. More particularly stated, said device comprises a housing having an indicating member therein which is colored to be readily seen through the housing and which is carried upon a diaphragm which is of inverted cup shape in form with said diaphragm being supported in extended position by a helical spring adjusted to balance the pressure differential between atmospheric pressure upon the diaphragm and the partial vacuum drawn upon the other side of said diaphragm by the air intake stream passing from the air filter to the air intake of an internal combustion engine whereby when a sufficient supply of air is passing into the air intake of the engine from said filter the device gives such an indication by being inoperative and when an air restriction develops in the air filter resulting from a build up of contaminants therein said partial vacuum on the air line passing to the device from the filter increases causing the diaphragm to collapse or fold in upon itself and draw downwardly the indicator which it carries to give a visual reading of the build up of contaminants within the air filter and when said air filter is fully contaminated to the point that sufficient air supply cannot be drawn therethrough, then said diaphragm becomes fully folded in upon itself and said device gives such a reading indicating the need for cleaning or replacing the air filter.

These and other objects and advantages of the invention will be set forth in the following description made in connection with the accompanying drawings in which like reference characters refer to similar parts throughout the several views and in which:

FIG. 1 is a broken view in side elevation showing the device herein in operating position;

FIG. 2 is a broken view in side elevation showing the device herein on an enlarged scale;

FIG. 3 is a view in vertical section on a further enlarged scale taken on line 3—3 of FIG. 2 as indicated;

FIG. 4 is a view similar to FIG. 2 showing portions thereof in a different position;

FIG. 5 is a view in vertical section on an enlarged scale taken on line 5—5 of FIG. 4 as indicated;

FIG. 6 is a view similar to FIG. 5 showing a modification thereof;

FIG. 7 is a broken view in horizontal section taken on line 7—7 of FIG. 6 as indicated;

FIG. 10 is a view similar to FIG. 8 showing a modification thereof;

FIG. 11 is a view in vertical section taken on line 11—11 of FIG. 10 as indicated, and FIG. 12 is a view in horizontal section taken on line 12—12 of FIG. 11 as indicated.

DESCRIPTION OF A PREFERRED EMBODIMENT

Figure 9:
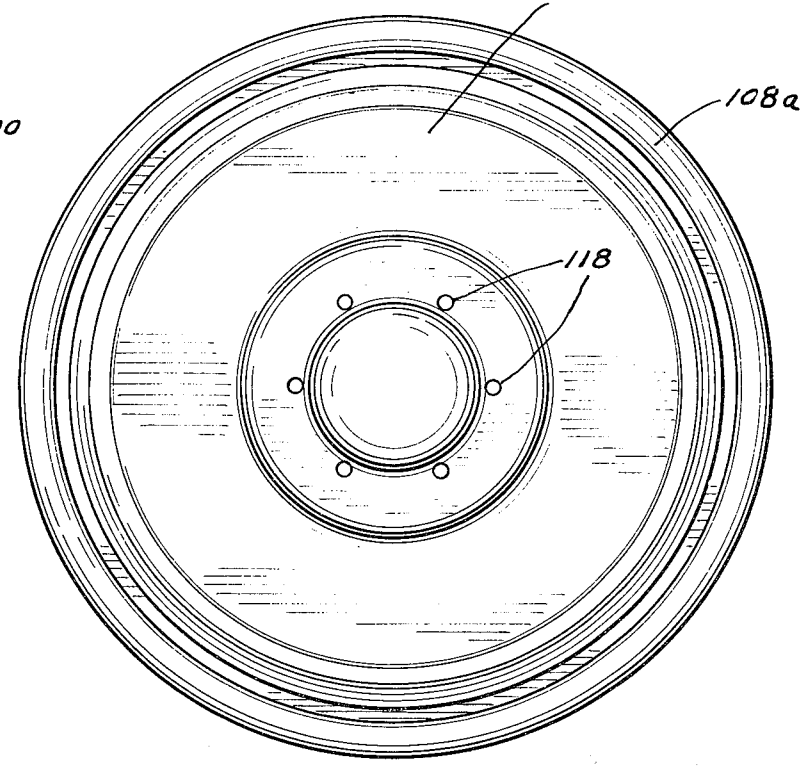
FIG. 9 is a top plan view with reference to FIG. 8.

Referring to the drawings, the device 10 forming an air filter restriction detection device and comprising the subject matter of the invention herein is shown in operating position connected by a pipe 12 to communicate with the air stream 15 passing through the stack 16 extending to the air filter 17 from the air intake 18 of an internal combustion engine 20 of which only a fragment is shown.

Referring to the FIGS. 2–5, said device 10 is shown comprising a cylindrical housing 25 preferably formed of a suitable plastic transparent material. Said housing has depending from its bottom wall 33 a tubular hub portion 27 internally threaded to receive said pipe 12 therein which pipe at its other end will be threaded into the stack 16.

Said housing is shown having a top wall 29 having an annular stepped flange portion 30 overlying the upper edge of the annular side wall 32 of said housing 25 and being suitably secured thereto as with an appropriate adhesive. Said housing has formed therein a chamber 35.

Said top wall 29 has a central tubular hub portion 37 depending therefrom into said housing 35 and having a portion 39 extending outwardly above said top wall 29 and having a bore 40 therein with a counter bore 42 being formed in the upper portion thereof. Seated within said counter bore is a porous air filter member 45 which may be suitably formed as of sintered bronze.

Disposed within said housing seated on the bottom of said chamber 35 is an inverted cup shaped diaphragm 47 made of a suitable flexible rubber material and having a rigid ring member 49 about the lower edge portion thereof integral therewith and in turn said ring member is suitably secured as by an adhesive to the adjacent bottom inner wall portion of said wall 32 as illustrated in FIG. 3.

Carried on said diaphragm 47 is a rigid flared cup shaped member 50 which has its upper edge portion bearing against the inner surface 29*a* of said top wall 29 as shown. As will be further described, said member 50 forms an air restriction indicating member.

Hence, said diaphragm 47 and said member 50 as shown in FIG. 3 extend from the bottom to the top of the chamber 35 within said housing 25. Supporting said diaphragm in extended position is a helical spring 52 having its largest coil resting on the bottom wall 33 of said housing and its smallest coil being retained within a shallow recessed cup like member 55 which abuts against the upper inner surface of said diaphragm 47. Threaded centrally through said member 50 and through said member 55 which is a bolt 60 having its upper slotted head portion 61 extending upwardly into said bore 40. Said bolt 60 secures together said diaphragm 47 and the upper cup member 50 carried thereon. Formed within said diaphragm is a chamber 47*a*.

Extending through the inner wall of said bore 40 is a slot or groove 62 forming an air passage to bypass said head 61 of said bolt 60.

One of the distinctive features of said cup member 50 is brightly colored as being a bright green. The significance of these colored portions will be described hereinafter. Said cup member is of such a height that it may be fully seated within the diaphragm with only the red rim portion visible as shown in FIGS. 4 and 5.

Said chamber 47*a* of said diaphragm 47 will be subjected to a partial vacuum drawn thereon as a result of its communication with the air stream 15 being drawn through the air filter 17 by the suction of the air intake member 18 of the engine 20.

The chamber 50*a* within said cup shaped member 50 is under atmospheric pressure with the passage of air through the filter 45 and the groove 62.

Said coil spring 52 is designed to have a compression factor to equalize the differential in pressure between that in chamber 50*a* and that in chamber 47*a*. It will be noted that this pressure differential may vary between different engines depending upon the vacuum which is drawn on the air filter 17 under a normal operating condition.

OPERATION

As above described, when the device 10 herein is initially installed, the coil spring 52 will be adapted to offset the pressure differential between the chamber 50*a* and the chamber 47*a* to hold the diaphragm 47 in its upwardly extended position as shown in FIGS. 2 and 3.

As the air filter 17 becomes loaded with contaminants, the contaminants restrict the flow of air drawn therethrough and as this restriction increases, the partial vacuum or suction upon the chamber 47*a* will increase upsetting the equilibrium initially established between said chambers 47*a* and 50*a*. Hence, as said restriction or clogging action increases, the suction on said chamber 50*a* will increase to cause a pressure drop in said chamber which will result in the collapse of the diaphragm which is drawn inwardly to fold upon itself. The restriction indicator 50 being carried by said diaphragm is drawn downwardly to be seated into the diaphragm to correspond with the downward inward folding movement of said diaphragm as shown in FIG. 5.

The operator will know that sufficient air is being drawn through the air filter 17 so long as a portion of the green body of said restriction indicator 40 is visible through the housing. The operator can gauge the length of useful life of the filter by the visible extent of the green area of said restriction indicator.

At such time as the air filter is so loaded with contaminants that insufficient air is being drawn therethrough to efficiently support combustion, the suction upon the chamber 47*a* will be such that the diaphragm will become fully collapsed or fully folded within itself down to the upper edge of the ring 49 extending thereabout. When this occurs, the indicator member 50 will have the entire extent of its green body portion drawn into said diaphragm and the only visible portion of said indicator will be the red band about its upper edge portion. Thus, when said green body portion of said indicator member 50 is fully drawn within the diaphragm and only the upper red edge or rim portion of said indicator is visible, this is the signal or the indication to the operator that it is time to check the air filter for cleaning or replacement of the same.

The use of an inverted cup-type diaphragm collapsing or folding in upon itself as controlled by the coil spring 52 permits a substantial linear movement of the indicating member 50 within a compact and relatively small housing.

MODIFICATION

Referring to FIGS. 6 and 7, a modification 80 of the device above described is shown in which the modification consists of the inclusion of an electrical circuit with said circuit embodying a signal located in such a place as to be readily visible and/or audible to the operator.

Said device will have its various elements corresponding to those above described bearing like reference numerals with primes added and the additional description herein will relate to the electrical circuit added.

A circuit 85 is provided having a pair of terminals 86 and 87 angled to extend through the top wall member 29′ and having their lower end portions 86*a* and 87*a* underlie and extend inwardly of the bottom of said hub 37′ and somewhat inwardly of said bore 40 whereby when said bolt 60′ is drawn downwardly to the point that the diaphragm 47′ is fully collapsed or folded inwardly upon itself, the head portion 61′ of said bolt will engage said terminal portions 86*a* and 87*a* to energize the circuit 85.

Running from said terminals 86 and 87 are lines 90 and 91 which will include an electrical source 92 such as a convenient battery and mounted upon the vehicle such as upon the dash thereof there will be a signal 93 shown here as a lamp but which may be a lamp and/or an audible alarm, whichever may be desired.

Thus here in the modification, the operator may either visually detect the need for cleaning or replacing an air filter by visual inspection of the device itself or in the alternative he may rely upon the signal 93 being actuated at such time as the filter requires cleaning or replacement. The visual inspection of the device itself will give the operator an indication of the condition of the filter by the extent to which the indicating member 50′ is drawn into the diaphragm 47′ and the alarm or signal may be used to indicate that time at which the air filter requires the operator's attention.

SECOND MODIFICATION

Figure 8:
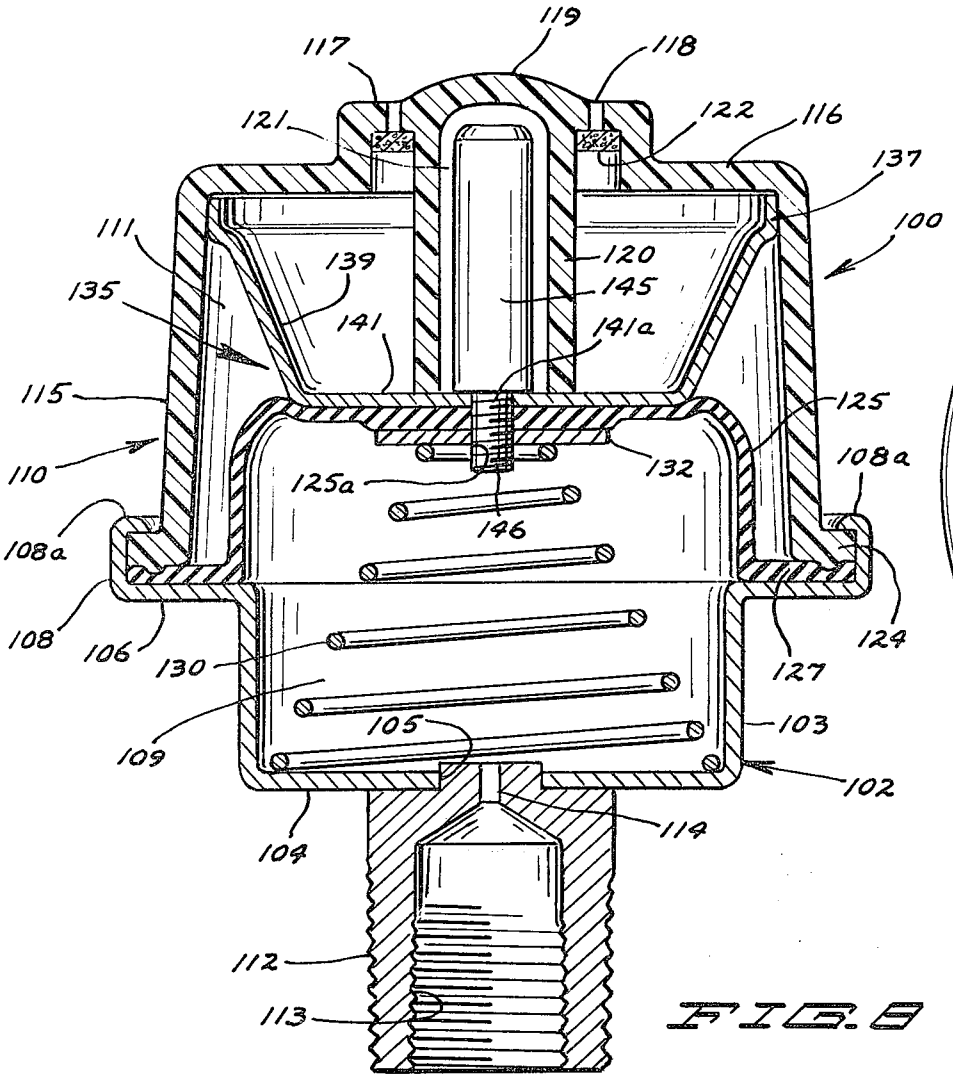
FIG. 8 is a view similar to FIG. 5 showing another modification thereof.
Figure 22:
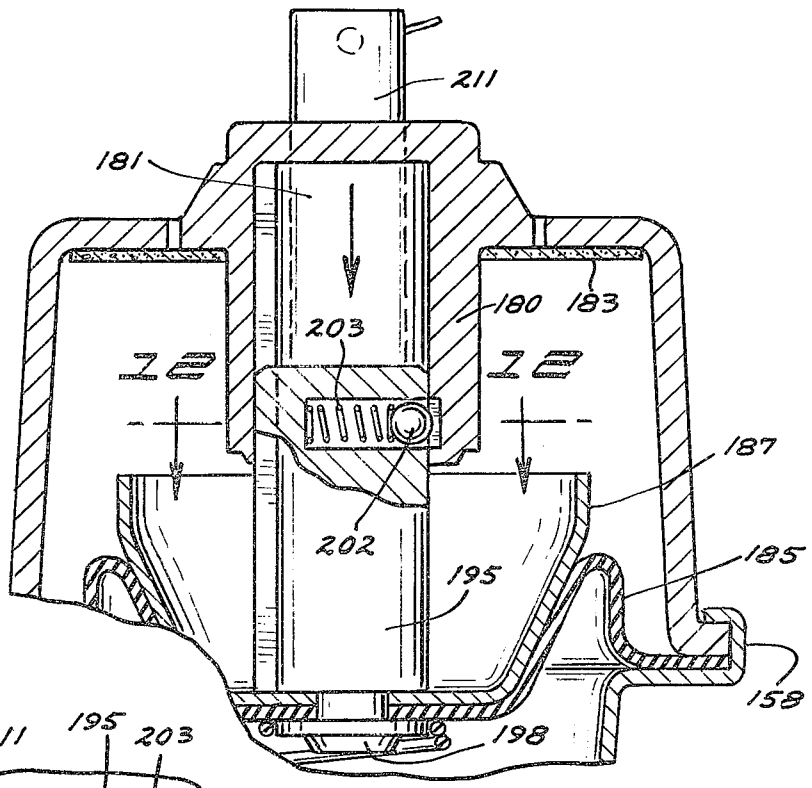
Figure 21:
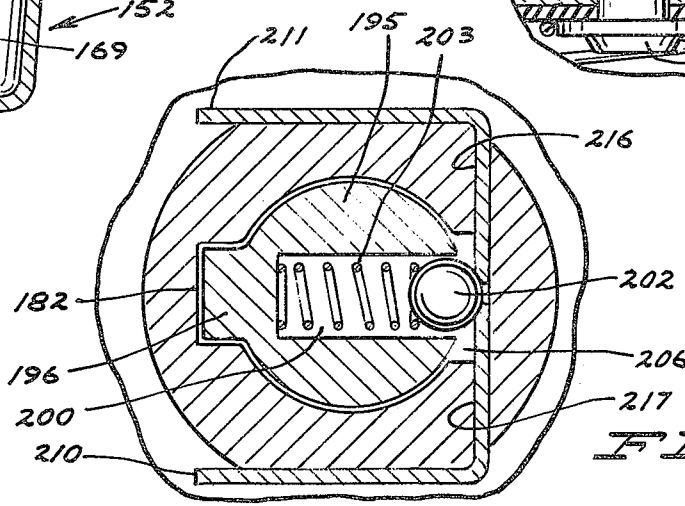
Figure 20:
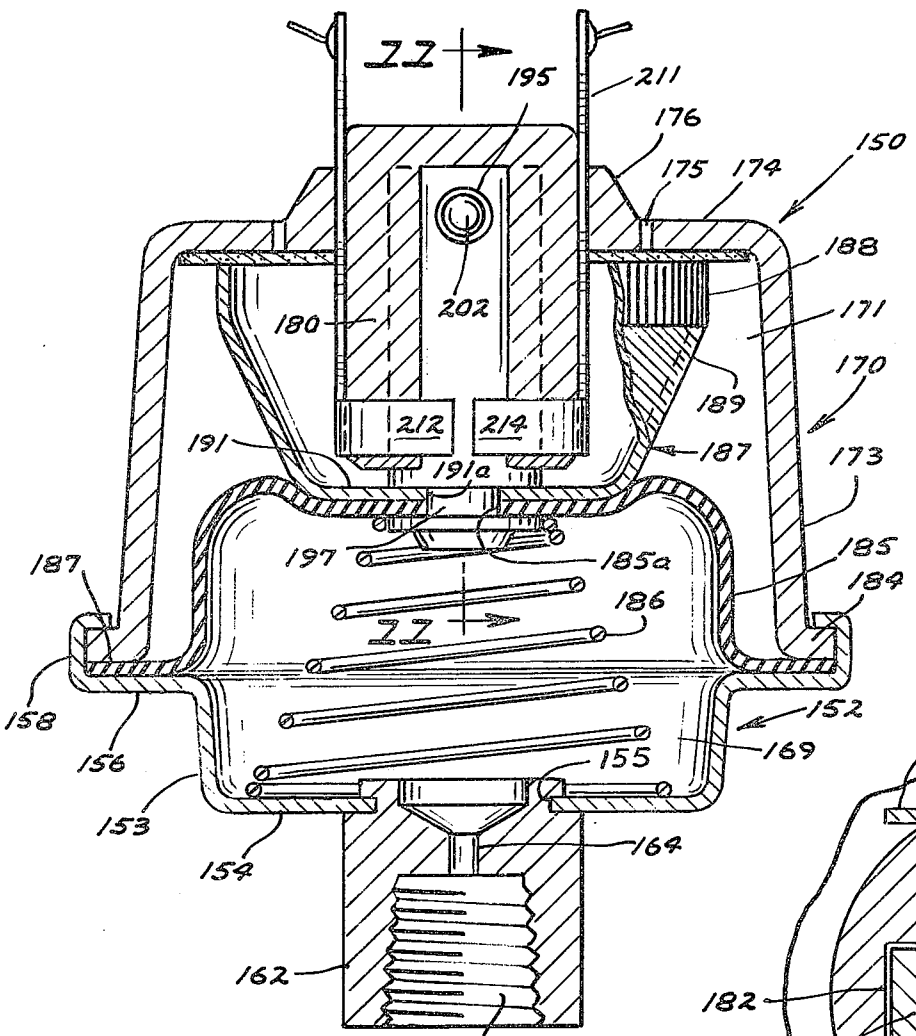

Referring to FIGS. 8 and 9, another modification of the device first above described is here shown and indicated by the reference numeral 100. Said device 100 comprises a lower cylindrical housing portion 102 having a side wall 103 and a bottom wall 104 having a central opening 105 therein and having an outwardly extending annular flange 106 about its upper edge portion, said flange having an upstanding edge or rim portion 108.

Secured to said bottom wall and depending therefrom is an externally threaded boss 112 having a passage 113 therethrough communicating through a restricted inlet 114 with the chamber 109 of said housing portion 102.

Said device 100 has an upper cylindrical housing portion 110 having a chamber 111 therein and being formed preferably of a transparent plastic material and comprising a side wall 115 having a top wall 116 and here shown having a central portion stepped domed raised portion 117 having a plurality of circularly arranged apertures 118 therethrough about a central domed portion 119.

Depending from the central portion 119 of said raised portion as shown from within said circle defined by said apertures is cylindrical boss 120 having a tubular chamber 121 therein open at its bottom end.

An annular air filter 122 is disposed about said boss 120 to underlie said apertures 118.

The lower end portion of said wall 115 is formed into an annular outwardly extending flange 124 which will rest upon said flange 106.

An inverted cup shaped diaphragm 125 is disposed within said housing portion 110, said diaphragm having at its lower end an outwardly extending annular flange 127 which is disposed between the flanges 106 and 124. Said outer rim portion 108 is crimped as at 108*a* to overlie the flange 124 and is pressed in place to securely engage said diaphragm flange 127 between the flanges 106 and 124.

Holding said diaphragm in upwardly extended position is a helical coiled spring 130 having its larger end supported by said bottom wall 104 about its perimeter and having its smaller end portion bearing against the upper end of said diaphragm and interposed between it and said diaphragm is a disc or plate member 132.

Supported on said diaphragm is an air filter restriction indicating member 135 shown here to be of a flared cup shape in form not unlike the member 50 above described having a brightly colored upper outer rim portion 137 such as being red, a body portion 139 of a contrasting bright color such as green and having a bottom wall 141.

Disposed within said upper boss 120 is a cylindrical bolt like member 145 forming a vertically movable guide member having a reduced threaded lower end portion 146 which extends through an accommodating aperture 141*a* of said bottom wall 141 and through the aperture 125*a* in said diaphragm to be threaded through said plate member 132 to secure together said diaphragm 125 and said indicating member 139. Said threaded portion 146 extends through said plate member 132 sufficiently to retain the upper reduced end of said coil spring 130 as shown.

The operation of the device 100 is in accord with the operation first above described and represents an economy in its manufacturer as compared to the device first above described.

THIRD MODIFICATION

Referring to FIGS. 10–12, another modification of the device herein is shown and is indicated generally by the reference numeral 150. This device is similar to what is shown in FIGS. 8 and 9 with an electrical signal added.

Said device comprises a lower cylindrical housing portion 152 having an annular side wall 153 and a bottom wall 154 having a central opening 155 therein and having an outwardly extending annular flange 156 about its upper edge portion, said flange having an upstanding edge or rim portion 158.

Secured to said bottom wall and depending therefrom is an internally threaded boss 162 having a passage 163 therethrough communicating through a restricted inlet 164 with the chamber 169 of said housing portion 152.

Said device 150 has an upper cylindrical housing portion 170 having a chamber 171 therein on the order of the housing portion 110 above described and having an annular side wall 173 having a top wall 174 having a stepped dome portion 176 having a plurality of circularly arranged apertures 175 therethrough forming air vents.

Depending from the central portion of said raised dome portion 176 is a cylindrical boss 180 having a cylindrical chamber 181 therein open at its bottom end and formed in said chamber at the rear thereof is one form of a guide means here shown or a vertical keyway 182.

An annular air filter 183 is disposed about said boss 180 to underlie said apertures 175.

The lower end portion of said wall 173 is formed into an annular outwardly extending flange 184 which will rest upon said flange 156.

A diaphragm 185 similar to the diaphragm 125 above described is provided having an outwardly extending flange 187 disposed between the flanges 184 and 156 and the edge portion 158 is crimped over said flange 184 as shown. Holding said diaphragm in extended position is a coil spring 186 as above described in connection with the spring 130.

Supported in said diaphragm 185 is an air filter restriction indicating member 187 similar to the member 135 above described having a colored outer upper rim portion 188 and a contrasting colored body portion 189 and having a bottom wall 191.

Disposed within said chamber 181 is a cylindrical bolt-like guide member 195 having means engaging said guide means here shown as a key 196 received in said keyway 182 forming a vertically movable guide member and having a reduced lower end portion 197 which extends through an accommodating central aperture 191*a* of said bottom wall 191 and through an aligned aperture 185*a* in said diaphragm to be secured by a lock nut 198.

A transverse slot 200 is formed within the upper portion of said guide member 195 having an electrically conductive ball 202 therein with a coil spring 203 disposed in said slot behind said ball. Said slot faces oppositely of said key 196. A vertical slot 206 is formed in said boss to retain said ball within said slot 200 permitting a partial projection thereof.

A pair of terminals 210 and 211 extend through said dome portion 176 which will be appropriately apertured and said terminals having their lower end portions 212 and 214 angled toward one another through slots 216 and 217 formed in said boss 180 with the adjacent ends of said terminals being spaced apart and disposed within the bottom of said vertical slot 206.

Said terminals will be included in a circuit such as circuit 85 above described.

The operation of this modification is as described above in connection with FIGS. 1–5 taken with the description of FIGS. 6 and 7.

When the diaphragm because of restriction in the air filter is pulled down to its lowered position as shown in FIG. 11, the ball 202 will contact the terminal portions 212 and 214 to open a circuit which will alert the operator by energizing a signal such as a light or an audible alarm on the dash of the vehicle. The ball 202 and the contacts 212 and 214 are sealed within the boss 180 to be free from contamination or corrosion.

In the various forms of the invention above described, a coil spring is shown supporting the respective diaphrams in extended position. It will be understood that although not here illustrated, it is within the scope of this invention to arrange and construct the respective cup-shaped indicators and diaphragms to balance the atmospheric pressure at one side of the diaphragm and the partial vacuum at the other side thereof without the use of resilient means such as a coil spring.

Thus it is seen that I have provided a simply constructed, efficiently operating air filter detection device which gives both a clear indication of the remaining usefulness of an air filter and also positively indicates the time at which the filter requires attention for cleaning or replacement.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. An air filter restriction indicating device, having in combination a housing having a top and bottom wall, and having an air filter in connection therewith, an inverted upstanding cup-shaped diaphragm having an upwardly disposed end wall, a flange secured about the open end portion of said diaphragm, means securing said flange to said housing thereabout, a flared cup shaped indicating member upstanding from said end wall of said diaphragm and secured thereto, said member bearing indicia upon its outer wall indicating the condition of restriction of said filter, apertures through said housing at one side of said diaphragm for communication of said indicating member with the atmosphere, a passage at the other side of said diaphragm through said housing communicating with the air stream passing from said air filter to an internal engine, a tapered helical coil spring upstanding from the bottom wall of said housing holding said diaphragm in upward extended position, said coil spring being arranged to have a compressive force representing the differential between atmospheric pressure and the partial vacuum drawn by said air stream on the other side of said diaphragm with the air filter being in a normally clean operating condition, a cylindrical boss extending downwardly into said indicating member from the top wall of said housing, a guide member upstanding within and secured to said indicating member freely moveable axially within said boss, and said housing being transparent to disclose said indicating member to show the progressive degree of restriction in said air filter and to indicate when said air filter requires replacement.

2. An air filter restriction indicating device, having in combination a housing having a top and bottom wall and having an air filter in connection therewith, a diaphragm of inverted cup shape disposed in said housing and having an upwardly disposed end wall, a spring member upstanding from the bottom wall of said housing holding said diaphragm in upwardly extended position, an indicating member upstanding from said end wall of said diaphram and carried thereabove, a passage through said housing at one side of said diaphragm venting said indicating member to the atmosphere, a passage at the other side of said diaphragm through said housing for connection between said other side of said diaphragm and the air stream passing from side air filter to an internal combustion engine, said air stream drawing a partial vacuum on said other side of said diaphragm, a cylindrical boss depending from the top wall of said housing into said indicating member, said boss having an open bottom chamber axially thereof, a cylindrical member upstanding from the end wall of said diaphragm moveably axially within said chamber, a transverse slot within said cylindrical member adjacent the upper portion thereof, a spring loaded ball in said slot, a pair of terminals carried by said boss adjacent the bottom thereof, said terminals having spaced adjacent end portions, said terminals having portions extending outwardly of said housing in circuit with a signal circuit, an aperture in said boss adjacent said terminals, said aperture being of such size as to permit said ball to extend there through sufficiently to engage said adjacent end portions of said terminals, and said diaphragm under sufficient partial vacuum drawn thereon by said air stream under restriction in said air filter moving said cylindrical member downwardly sufficiently for said ball to be in alignment with and extend through said aperture in said boss to open a signal circuit by engaging said adjacent terminals.

* * * * *